US005212875A

United States Patent [19]

Corso

[11] Patent Number: 5,212,875

[45] Date of Patent: May 25, 1993

[54] CHALK LINE ASSEMBLY HAVING MULTIPLE LINES AND A MOTORIZED WINDING MECHANISM

[76] Inventor: Joseph R. Corso, 2334 S. 12th St., Philadelphia, Pa. 19148

[21] Appl. No.: 821,180

[22] Filed: Jan. 15, 1992

[51] Int. Cl.[5] ..... B44D 3/38

[52] U.S. Cl. ..... 33/414; 33/756; 242/84.8

[58] Field of Search ..... 33/413, 414, 756, 759, 33/760, 761, 755; 242/96, 84.8, 86.5 A

[56] References Cited

U.S. PATENT DOCUMENTS

| | | | |
|---|---|---|---|
| 3,046,663 | 7/1962 | Romero | 33/414 |
| 3,126,637 | 3/1964 | Short | 33/414 |
| 3,206,855 | 9/1965 | Fletcher | 33/414 |
| 3,311,319 | 3/1967 | Campbell | 242/84.8 |
| 4,192,078 | 3/1980 | Lore et al. | 33/414 |
| 4,304,372 | 12/1981 | Smith et al. | 242/86.5 A |
| 4,773,162 | 9/1988 | Lin | 33/756 |

*Primary Examiner*—William A. Cuchlinski, Jr.
*Assistant Examiner*—Alvin Wirthlin
*Attorney, Agent, or Firm*—Connolly & Hutz

[57] ABSTRACT

A chalk line assembly includes a plurality of chalk containing chambers. A reel is mounted in each chamber. Each reel contains a hollow drum with a line mounted around each drum and exiting from its chamber. A shaft is slidably mounted through the aligned reel drums. The shaft includes locking structure engageable with complementary locking structure on the hubs so that the shaft may be brought into locking engagement with a selecting hub to permit the line from that reel to be extended and then rewound.

28 Claims, 3 Drawing Sheets

Fig. 4.
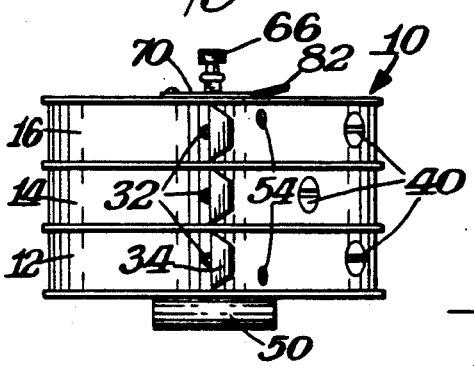
Fig. 5.
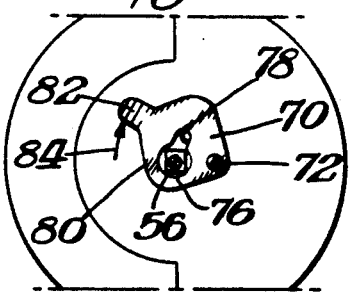
Fig. 1.
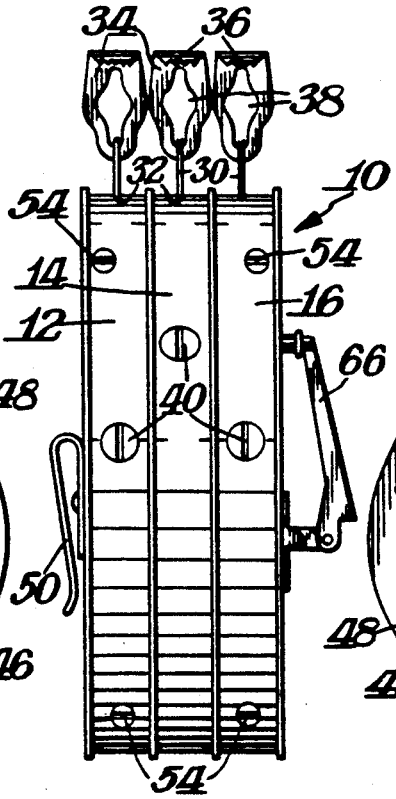
Fig. 3.
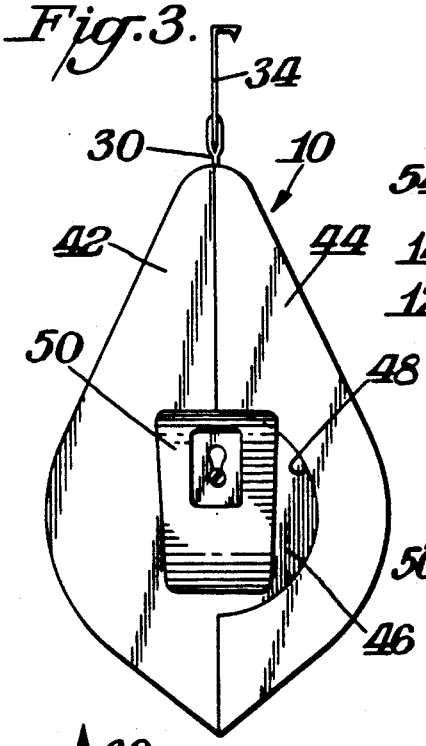
Fig. 2.
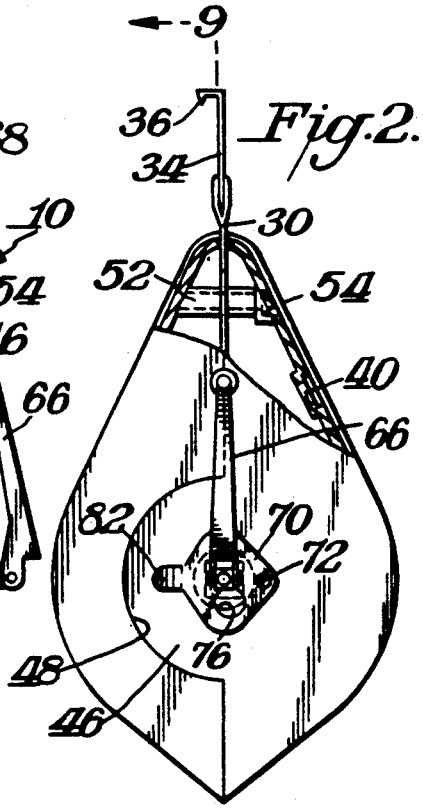
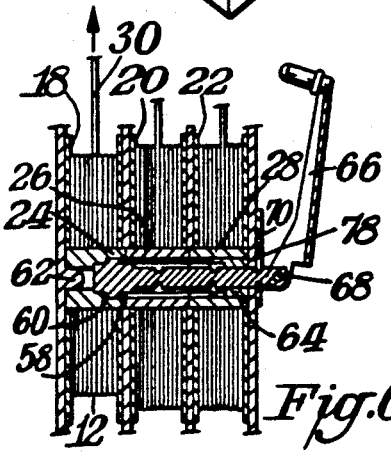
Fig. 6.
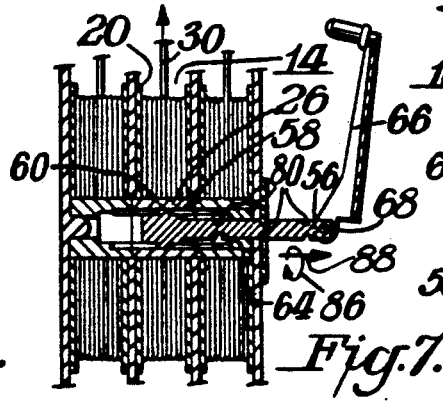
Fig. 7.
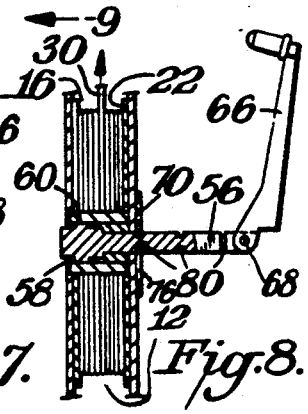
Fig. 8.

CHALK LINE ASSEMBLY HAVING MULTIPLE LINES AND A MOTORIZED WINDING MECHANISM

BACKGROUND OF THE INVENTION

Chalk lines are customarily used in carpentry work to enable straight lines to be formed. Frequently it is necessary to provide a number of lines for different purposes, such as for the location of studs, windows, panels, holes and the like. Where multiple lines are required it would be advantageous if different colors could be used to readily distinguish one line from another. U.S. Pat. No. 3,046,663 discloses a three line chalk box which attempts to solve these problems. U.S. Pat. No. 1,004,443 exemplifies a further arrangement having multiple chalk lines.

SUMMARY OF INVENTION

An object of this invention is to provide a chalk line assembly having multiple chalk lines.

A further object of this invention is to provide such a chalk line assembly which can be operated in a simple yet reliable manner for permitting the individual chalk lines to be extended and then selectively rewound.

In accordance with this invention a chalk line assembly includes a plurality of chalk containing chambers each of which preferably contains different colored chalk. A reel is mounted in each chamber with a line wound around the drum of each reel. The free end of each line exits from an exit opening of its respective chamber. A shaft slidably extends through the aligned drums. The shaft includes a locking element which is selectively engaged with complementary locking elements on the drums. Accordingly, by properly engaging the shaft locking element with a particular drum it is possible to selectively rewind each line.

In the preferred practice of this invention there are at least three chalk containing chambers. The drum locking elements preferably include a keyway while the shaft locking element is a spline disposed in the keyway. An indexing mechanism may be provided for holding the shaft in locking engagement with the desired drum.

THE DRAWINGS

FIG. 1 is a side elevational view of a chalk line assembly in accordance with this invention;

FIG. 2 is a front elevational view of a chalk line assembly shown in FIG. 1;

FIG. 3 is a rear elevational view of a chalk line assembly shown in FIGS. 1–2;

FIG. 4 is a top plan view of the chalk line assembly shown in FIGS. 1–3;

FIG. 5 is a front elevational view similar to FIG. 2 of a portion of the chalk line assembly shown in FIGS. 1–4 in a different phase of operation;

FIG. 6 is a cross-sectional view in elevation showing engagement of the shaft with an endmost reel;

FIG. 7 is a view similar to FIG. 6 showing engagement of the shaft with the intermediate reel;

FIG. 8 is a cross-sectional view of the opposite end portion of the assembly shown in FIGS. 1–7 showing the shaft in engagement with the endmost reel;

DETAILED DESCRIPTION

Figure 10:
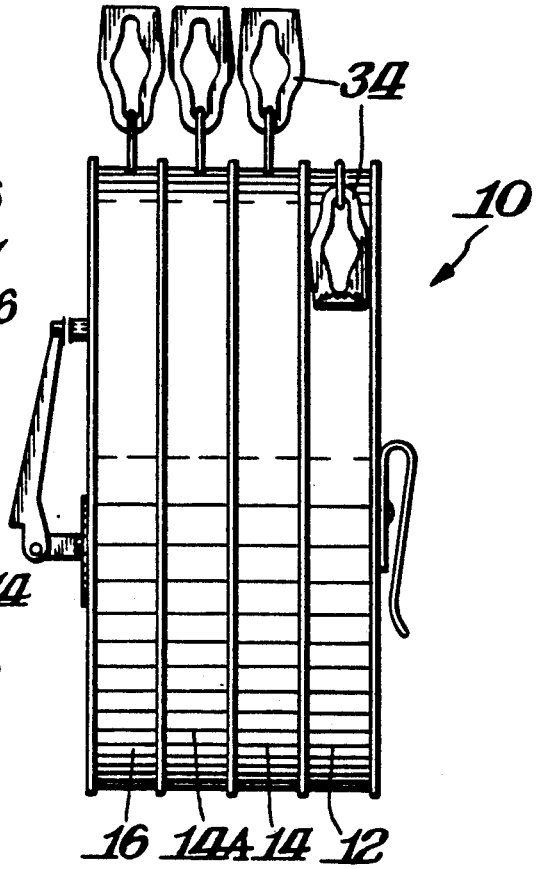
FIG. 10 is a side elevational view of a modified form of chalk line assembly in accordance with this invention.

The present invention as illustrated herein relates to a chalk line assembly 10 which is particularly designed to have the ability to make multiple chalk lines each of a different color. As shown herein chalk line assembly 10 comprises a housing containing a plurality of aligned chalk containing chambers 12, 14, 16, three of which are illustrated in FIG. 1. It is to be understood, however, that in its broadest concept, the invention comprises having a plurality of such chambers, as little as two and any number greater thereof. FIG. 10, for example, illustrates four such chambers 12, 14, 14A, 16.

Each chamber contains a reel 18, 20, 22 as best illustrated in FIGS. 6–7. Each reel is in the form of a pair of side walls and an axially located hollow drum 24, 26, 28. A chalk line 30 is wound around the drum of each reel. Each chamber includes an exit opening 32 through which the free end of the chalk line extends with the opposite end being anchored to its respected drum. As illustrated in, for example, FIGS. 1 and 2, the free end of each chalk line 30 is provided with an anchoring member 34 which may take any suitable conventional form, such as having a serrated hook end 36 and an elongated opening 38.

Each chamber is provided with a fill opening which is closed by any suitable closure, such as screw cap 40. In this manner, it is possible to insert a suitably colored powder or chalk into each chamber with the powder or chalk of each chamber being maintained separate from the other chambers so that the chalk line 30 in each chamber will thus have a correspondingly different color.

As illustrated, for example, in FIGS. 2, 3 and 5 the housing of assembly 10 is formed from a pair of shells 42, 44 which when mated together form the closed housing for the chambers. In a preferred practice of the invention shell 42 includes an arcuate extension 46 which mates with a corresponding concave edge 48 of shell 44. As a result, a solid wall formed by extension 46 is formed at the central area of the reels. The provision of the solid wall is advantageous in that should access be needed to the interior of the housing it is possible to remove the smaller shell 44 and still have all of the remaining components of assembly 10 mounted within shell 42. Additionally, the solid wall provided by extension 46 at end chamber 12 permits a belt clip 50 to be attached thereto so that the housing or assembly 10 can readily be worn by the user. The solid wall 46 at the opposite end of chamber 16 also provides a support structure for the later described shaft and indexing plate. Shells 42,44 may be secured together in any suitable manner. For example, FIGS. 1–2 illustrate shell 42 to include internally threaded tubular extensions 52 into which a threaded fastener 54 may be secured from shell 44. In the illustrated embodiment four of such tubular extensions 52 and fasteners 54 are provided.

The hollow axial opening of drums 24, 26, 28 is of noncircular shape, such as a square or oval. In the illustrated embodiment the preferred shape is shown as being square. Disposed within the hollow drums is a slidably mounted shaft 56 which has a shape corresponding to that of the hollow drum opening. Thus, in the illustrated embodiment the cross-sectional shape of shaft 56 is square. The hollow drums, 24, 26, 28 include an aligned slot or keyway 58 forming a track into which a spline or extension 60 of shaft 56 is disposed. Any suitable number of keyways and splines may be utilized. In the preferred practice of the invention a pair of diametrically opposite splines and keyways are utilized. The splines and keyways form complementary locking structure on the drums and shaft so that shaft 56 is mechanically engaged to a selective reel in accordance with the axial location of its splines 50 with respect to the drums 24, 26, 28.

As shown in FIGS. 6-7 clearance is provided between shaft 56 and the axial openings of the drums except where the spline 60 of shaft 56 engages a keyway 58 in one of the drums. This clearance is sufficiently large to permit the shaft 56 to rotate without causing the drums to rotate except for the drum having its keyway 58 engaged by spline 60.

FIG. 6, illustrates shaft 56 to be disposed in its fully inserted position. As shown therein, splines 60 are engaged with the keyways 58 in drum 24 of reel 18. FIG. 7 shows shaft 56 after it has been slidably moved to its intermediate position where its splines 60 engage the keyways 58 of reel 20. FIG. 8 illustrates shaft 56 being fully extended with its splines 60 engaged in the keyways 58 of end reel 22. It is noted that for simplicity of illustration only reel 22 is illustrated in FIG. 8 and the remaining reels which would be part of assembly 10 are not shown.

Figure 9:
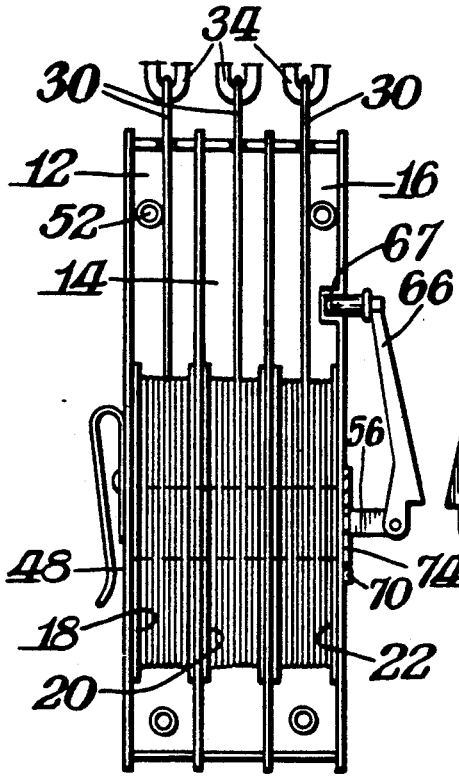
FIG. 9 is a view looking in the direction of the line 9—9 of FIG. 2.

As best illustrated in FIGS. 6-8 an axial projection 62 is provided on the end wall adjacent reel 18 to support drum 24. Similarly, a drum supporting surface 64 extends inwardly from the end wall of reel 22. Reels 18, 20, and 22 are mounted in assembly 10 in any suitable manner to permit the reels to rotate within each respective chamber when its line 30 is being extended or rewound. During the extension of chalk lines 30 from assembly 10 the location of shaft 56 is not critical. Accordingly, any or all of the chalk lines may be extended from their respective chambers to form a chalk line. For purposes of rewinding, however, only a single chalk line is rewound at a time. The particular chalk line which is being rewound will be determined by which reel is engaged by the spline 60 of shaft 56. The free end of shaft 56 includes a crank or handle 66 which may be pivotally connected to shaft 56 by pivot pin 68 so that handle 66 could be disposed in one of two positions. In its inactive condition the end of handle 66 is snapped into recess or pocket 67, as shown in FIG. 9. In its operative condition handle 66 is moved pivotally outwardly to provide better access to the user as shown in FIGS. 6-8.

One of the features of this invention is the incorporation of an indexing mechanism for maintaining shaft 56 in its desired position with respect to each of the reels 18, 20, 22. The indexing mechanism is best shown in FIGS. 2 and 5. As illustrated therein the indexing mechanism includes a plate 70 pivotally mounted by pivot pin 72 against the outer surface of wall extension 46 at end chamber 16. Plate 70 is preferably made of a springy material so that it is ordinarily maintained in surface contact with wall extension 46 to avoid any tendency for a shifting or changing of position of plate 70.

As best shown in FIG. 5, plate 70 includes a key hole opening 74 which has a large circular portion 76 and a narrow extension 78. The circular portion 76 is made at least as large as the cross-sectional area of shaft 56 so that shaft 56 may readily slide through the enlarged portion 76. The extension 78, however, is made of a narrower size than the cross-section of shaft 56. Shaft 56 in turn includes peripheral annular recesses 80 forming circular cross-section areas on shaft 56 at the location of these peripheral recesses or notches. The cross-sectional shape of shaft 56 at notches or recesses 80 is slightly smaller than the size of opening extension 78. As also illustrated, plate 70 includes an outwardly turned handle portion or tab 82 to permit rotation of plate 70.

When it is desired to change the position of shaft 56 plate 70 is rotated to the position shown in FIG. 5 wherein the enlarged portion 76 of key hole opening 74 is aligned with shaft 56. Shaft 56 may thus readily slide axially within the aligned openings of drum 24, 26, 28 with its splines 60 sliding in the tracks formed by keyways 58. When shaft 56 is properly positioned a respective recess 80 will be disposed at key hole opening 74. Plate 70 is then rotated in the direction opposite that of arrow 84 of FIG. 5 to the position shown in FIG. 2 where the narrow portion 78 of key hole opening 74 is disposed around the respective peripheral recess 80 thus axially locking shaft 56 in place. When in this locked condition crank or handle 66 is rotated as indicated by the arrow 86 of FIG. 7 to rewind the line 30 on the respective reel in engagement with shaft 56. It is noted that the sliding movement of shaft 56 is indicated by the arrow 88 in FIG. 7.

The exit openings 32 of chambers 12, 14, 16 may be located in any suitable manner with respect to each other. For the sake of convenience, however, the exit openings are mounted in alignment.

Figure 11:
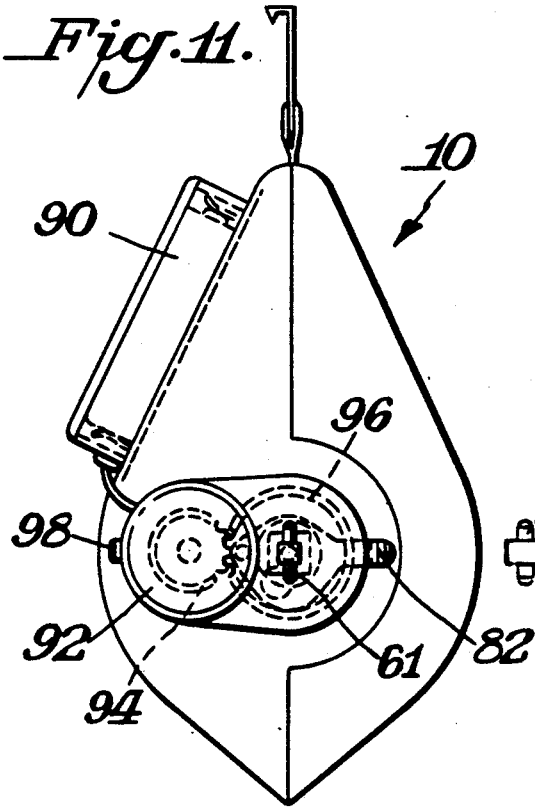
FIG. 11 is a front elevational view of yet another embodiment of this invention.
Figure 12:
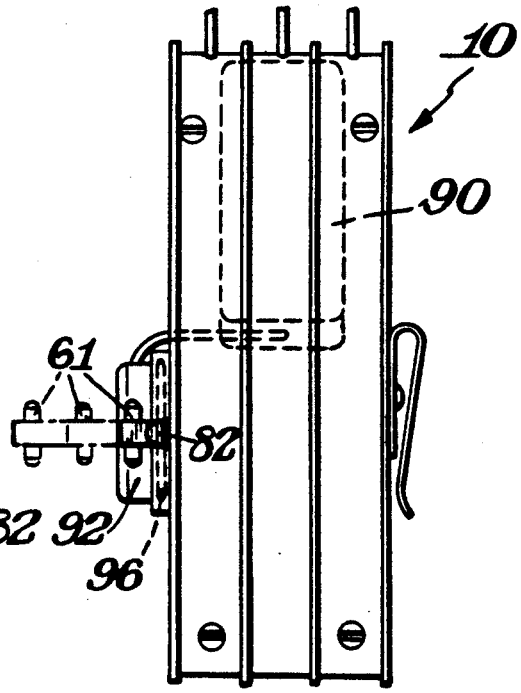
FIG. 12 is a side elevational view of the embodiment of the invention shown in FIG. 11.

In the preferred practice of this invention, from a cost standpoint, the rewinding is accomplished manually by the rotating of crank or handle 66. Other means of rewinding, however, may also be utilized in accordance with this invention. FIGS. 11-12, for example, illustrate a variation where the rewinding is accomplished electrically by the use of a motorized connection to shaft 56. As shown therein a battery pack 90 provides power for motor 92 so that the drive gear 94 of motor 92 will driveably engage gear 96 mounted to shaft 56. Shaft 56 may be slideably connected to gear 96 to permit shaft 56 to slide while gear 96 remains axially in place. Actuating button 98 is provided to control the rotational operation of shaft 56. Since shaft 56 does not include a handle, nubs or gripping members 61 are provided on shaft 56 to facilitate the user gripping the exposed end of shaft 56 and sliding shaft 56 inwardly or outwardly.

Figure 13:
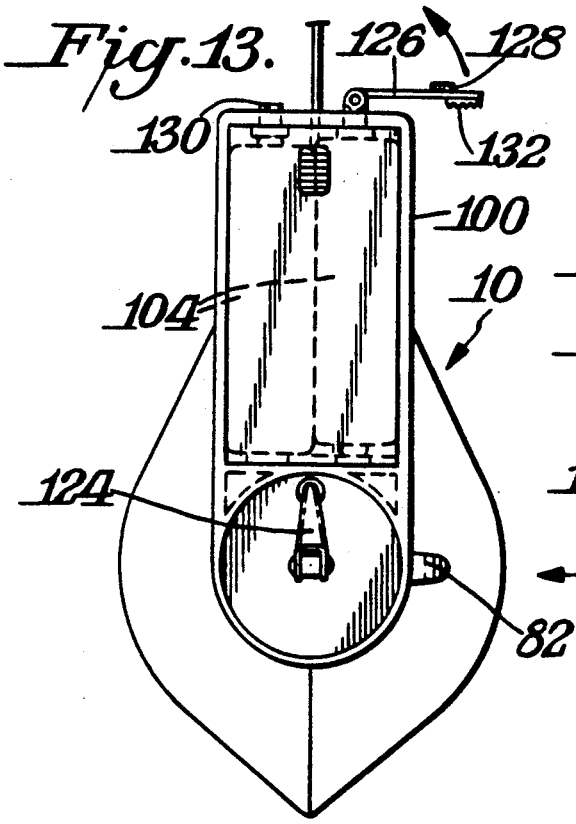
FIG. 13 is a front elevational view of yet a further embodiment of this invention.
Figure 14:
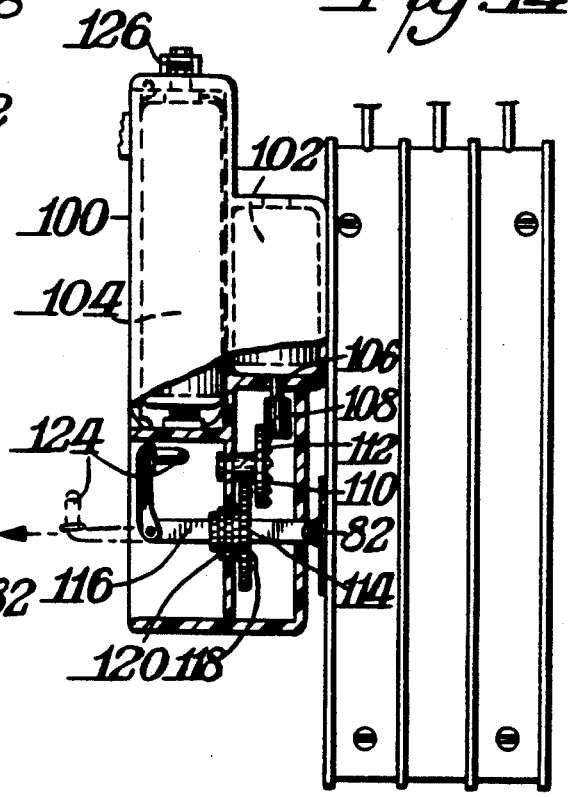
FIG. 14 is a side elevational view, partly in section, of the embodiment shown in FIG. 13.

FIGS. 13-14 show yet another form of assembly 10. This version represents a variation of the embodiment shown in FIGS. 11-12 wherein the chalk line is motor operated. As illustrated in FIGS. 13-14 a housing 100 is mounted to the side of the shells forming the chalk lines chambers. Housing 100 includes a compartment in which a motor 102 is located. Motor 102 is powered by a pair of conventional batteries 104 best shown in FIG. 13. Motor 102 includes a shaft 106 terminating in a gear 108 which engages with and drives disk gear 110 axially connected to gear 112 for driving gear 114 mounted to shaft 116. Shaft 116 includes a stop 118 and a snap ring 120.

Shaft 116 would operate in the same manner as shaft 56 in that it could be moved longitudinally for engagement with the various drums in each chamber.

Handle 124 may be pivotally secured to shaft 116 so that when the device is motor operated handle 124 could be moved perpendicular to shaft 116 and be totally encased in an opening in housing 100. Under circumstances where handle 124 is to be used for rotating a drum, handle 124 could be rotated to the position shown in phantom in FIG. 14 where it is generally in line with shaft 116 and exposed from housing 100.

The power pack or batteries could be selectively operated by the provision of a pivoted switch 126 made of brass or other suitable material having a contact button 128 which would engage the terminal 130 on the remote battery. The manipulating portion 132 of switch 126 could be made of a suitable plastic material.

The arrangement of FIGS. 13–14 is particularly advantageous under circumstances where it is intended to hand crank the lines rather than use the power from a motor. For example, such need may arise where there is battery failure or line entanglement. If desired, handle 124 could be detachably connected to shaft 116 and attached only when needed.

The provision of a motor operated chalk line assembly such as illustrated in FIGS. 11–12 or 13–14 represents a significant improvement over the conventional approaches taken by the prior art. It is to be understood that the concept of having a motor driven chalk line assembly could be used for any suitable number of chalk lines including as little as only one chalk line. It is also to be understood that the various features shown with respect to individual embodiments of this invention may be used with other embodiments.

Any suitable materials may be used for forming assembly 10. For example, the housing itself may be formed from a cast aluminum or molded plastic material. The chalk lines and powder would be of any conventional construction. The number of reels provided in assembly 10 would be determined by such matters as size, convenience, weight and needs.

What is claimed is:

1. A chalk line assembly comprising a housing having a plurality of aligned chalk containing chambers, a reel in each of said chambers, each of said reels containing a hollow drum, each of said drums having an axial opening therethrough, a chalk line mounted around each of said drums, an exit opening in each of said chambers, each of said chalk lines having one end anchored to its respective drum and an opposite free end extending from its respective exit opening, said reel drums being aligned with each other and having their axial openings aligned, a shaft slidably mounted axially through said drums, each of said drums having locking structure in its axial opening, said shaft having an outer surface with complementary locking structure for selective engagement with said locking structure of a respective one of said drums to lock said shaft to said respective one of said drums, and means for rotating said shaft to selectively rewind each of said lines on its respective reel.

2. The assembly of claim 1 including indexing means for maintaining said shaft in locking engagement with its respective drum.

3. The assembly of claim 2 wherein each of said chambers contains different colored powder whereby each of said chalk lines is of a different color.

4. The assembly of claim 3 wherein there are at least three of said chambers, and each of said chambers having an access opening.

5. The assembly of claim 4 including an anchor member mounted to each of said free ends of said chalk lines.

6. The assembly of claim 3 wherein said exit openings are aligned with each other.

7. The assembly of claim 3 wherein said axial opening of each of said drums includes a keyway with said keyways being alignable with each other to form a track which comprises said locking structure of said drums, and said shaft having a spline slidably mounted in said track whereby said spline comprise said locking structure of said shaft.

8. The assembly of claim 7 wherein said shaft includes a plurality of peripheral recesses corresponding to the number of said drums, said shaft being of circular cross-section at each of said peripheral recesses, and said indexing means comprising a locking plate having locking structure movable into selective engagement with a respected one of said recesses.

9. The assembly of claim 2 wherein each of said drums includes a keyway with said keyways alignable with each other to form a track which comprises said locking structure of said drums, and said shaft having a spline slidably mounted in said track whereby said spline comprises said locking structure of said shaft.

10. The assembly of claim 9 wherein said shaft includes a plurality of peripheral recesses corresponding to the number of said drums, said shaft being of circular cross-section at each of said peripheral recesses, and said indexing means comprising a locking plate having locking structure movable into selective engagement with a respective one of said recesses.

11. The assembly of claim 1 wherein each of said chambers contains different colored powder whereby each of said chalk lines is of a different color.

12. The assembly of claim 1 wherein said means for rotating said shaft comprises motorized means coupled to said shaft for rotating said shaft in response to actuation of said motorized means.

13. The assembly of claim 12 wherein said motorized means comprises a drive housing, a motor in said drive housing engageable with said shaft by transmission means for rotating said shaft when said motor is actuated, power means, for selectively actuating said motor, a switch connected to said power means movable to an activating position and a non-activating position to control the actuation of said power means and a handle mounted to said shaft for manually rotating said shaft when said power means is inactivated.

14. The assembly of claim 13 wherein said handle is detachably mounted to said shaft.

15. A chalk line assembly comprising a housing having a plurality of aligned chalk containing chambers, a reel in each of said chambers, each of said reels containing a hollow drum, a chalk line mounted around each of said drums, an exit opening in each of said chambers, each of said chalk lines having one end anchored to its respective drum and an opposite free end extending from its respective exit opening, said reel drums being aligned with each other, a shaft slidably mounted axially through said drums, each of said drums having locking structure, said shaft having complementary locking structure for selective engagement with said locking structure of a respective one of said drums to lock said shaft to said respective one of said drums, means for rotating said shaft to selectively rewind each of said lines on its respective reel, indexing means for maintaining said shaft in locking engagement with its respective drum, each of said chambers containing different colored powder whereby each of said chalk lines is of a different color, said axial opening of each of said drums including a keyway with said keyways being alignable with each other to form a track which comprises said locking structure of said drums, said shaft having a spline slidably mounted in said track whereby said spline comprise said locking structure of said shaft, said shaft including a plurality of peripheral recesses corresponding to the number of said drums, said shaft being of circular cross-section at each of said peripheral recesses, said indexing means comprising a locking plate having locking structure movable into selective engagement with a respected one of said recesses, said locking plate being rotatably mounted to the outer surface of said housing, said locking plate having a key hole opening which includes an enlarged portion and a narrow extension, said shaft being of non-circular cross-section except where said recesses are located, said drums having axial openings of complementary non-circular shape, said non-circular cross-section of said shaft being dimensioned whereby said shaft may slide through said enlarged portion of said key hole openings but not through said narrow extension, and said narrow extension being disposed for selected positioning around a respective one of said recesses to lock said shaft in axially position with its said spline in engagement with a respective one of said drums.

16. The assembly of claim 15 including a belt clip mounted to said housing on the side of said housing opposite of said plate.

17. The assembly of claim 16 wherein said housing is formed by a pair of mating shells, one of said shells having an enlarged extension fitting in a complementary shaped edge of the other of said shells, said belt clip being mounted to said enlarged extension, and said locking plate being mounted to said enlarged extension on the side of said housing opposite said belt clip.

18. The assembly of claim 17 wherein said means for rotating said shaft comprises a crank mounted to the end of said shaft at said side of said housing having said locking plate whereby said shaft may be manually rotated by rotation of said crank, and said crank being pivotally mounted to an inactive position in engagement with said housing and an operative position disposed away from said housing.

19. The assembly of claim 17 wherein said means for rotating said shaft comprises motorized means coupled to said shaft for rotating said shaft in response to actuation of said motorized means.

20. A chalk line assembly comprising a housing having a plurality of aligned chalk containing chambers, a reel in each of said chambers, each of said reels containing a hollow drum, a chalk line mounted around each of said drums, an exit opening in each of said chambers, each of said chalk lines having one end anchored to its respective drum and an opposite free end extending from its respective exit opening, said reel drums being aligned with each other, a shaft slidably mounted axially through said drums, each of said drums having locking structure, said shaft having complementary locking structure for selective engagement with said locking structure of a respective one of said drums to lock said shaft to said respective one of said drums, means for rotating said shaft to selectively rewind each of said lines on its respective reel, indexing means for maintaining said shaft in locking engagement with its respective drum, each of said drums including a keyway with said keyways being alignable with each other to form a track which comprises said locking structure of said drums, said shaft having a spline slidably mounted in said track whereby said spline comprising said locking structure of said shaft, said shaft including a plurality of peripheral recesses corresponding to the number of said drums, said shaft being of circular cross-section at each of said peripheral recesses, said indexing means comprising a locking plate having locking structure movable into selective engagement with a respected one of said recesses, said locking plate being rotatably mounted to the outer surface of said housing, said locking plate having a key hole opening which includes an enlarged portion and a narrow extension, said shaft being of non-circular cross-section except where said recesses are located, said drums having aligned openings of complementary non-circular shape, said non-circular cross-section of said shaft being dimensioned whereby said shaft may slide through said enlarged portion of said key hole openings but not through said narrow extension and said narrow extension being disposed for selected positioning around a respective one of said recesses to lock said shaft in axially position with its said spline in engagement with a respective one of said drums.

21. The assembly of claim 20 including a belt clip mounted to said housing on the side of said housing opposite of said plate.

22. The assembly of claim 21 wherein shad housing is formed by a pair of mating shells, one of said shells having an enlarged extension fitting in a complementary shaped edge of the other of said shells, said belt clip being mounted to said enlarged extension, and said locking plate being mounted to said enlarged extension on the side of said housing opposite said belt clip.

23. A chalk line assembly comprising a housing having a plurality of aligned chalk containing chambers, a reel in each of said chambers, each of said reels containing a hollow drum, a chalk line mounted around each of said drums, an exit opening in each of said chambers, each of said chalk lines having one end anchored to its respective drum and an opposite free end extending from its respective exit opening, aid reel drums being aligned with each other, a shaft slidably mounted axially through said drums, each of said drums having locking structure, said shaft having complementary locking structure for selective engagement with said locking structure of a respective one of said drums to lock said shaft to said respective one of said drums, means for rotating said shaft to selectively rewind each of said lines on its respective reel, said means for rotating said shaft comprising motorized means coupled to said shaft for rotating said shaft in response to actuation of said motorized means, said motorized means comprising a drive housing, a motor in said drive housing engageable with said shaft by transmission means for rotating said shaft when said motor is actuated, power means for selectively actuating said motor, a switch connected to said power means movable to an activating position and a non-activating position to control the actuation of said power means, a handle mounted to said shaft for manually rotating said shaft when said power means is inactivated, said handle being pivotally mounted to said shaft to be selectively pivoted to a first position and to a second position, said handle being pivoted to said first position and being completely disposed within said drive housing when said power means is in its activated position, and said handle being pivoted to said second position and extending outside of said housing when said power means is in its inactivated position.

24. A chalk line assembly comprising a housing having a plurality of chalk containing chambers, a reel in each chalk containing chamber, said reel containing a hollow drum, a chalk line mounted around said drum, an exit opening in said chamber for said chalk line, said chalk line having one end anchored to said drum and an opposite end extending through said exit opening, a shaft slidably mounted axially through said drums, said shaft having locking means for engagement with complementary locking structure on said drums to selectively lock said shaft to a respective one of said drums, means for rotating said shaft to rewind said line, said means for rotating said shaft comprising motorized means coupled to gear means on said shaft for rotating said shaft in response to actuation of said motorized means, and said motorized means being coupled to said gear means when said shaft is selectively locked to each of said drums in accordance with the sliding movement of said shaft.

25. The assembly of claim 24 wherein said motorized means comprises a drive housing, a motor in said drive housing engageable with said shaft by transmission means for rotating said shaft when said motor is actuated, power means for selectively actuating said motor, a switch connected to said power means movable to an activating position and a non-activating position to control the actuation of said power means, and a handle mounted to said shaft for manually rotating said shaft when said power means is inactivated.

26. The assembly of claim 24 wherein said motorized means includes a gear, and said shaft being slideably connected to said gear whereby said gear is maintained connected to said gear means on said shaft when said shaft is slidably moved to be selectively locked to each of said drums.

27. A chalk line assembly comprising a housing having at least one chalk containing chamber, a reel in each chalk containing chamber, said reel containing a hollow drum, a chalk line mounted around said drum, an exit opening in said chamber for each chalk line, said chalk line having one end anchored to said drum and an opposite end extending through said exit opening, a shaft mounted axially through said drum, said shaft having locking structure for engagement with complementary locking structure on said drum to lock said shaft to said drum, means for rotating said shaft to rewind said line, said means for rotating said shaft comprising motorized means coupled to said shaft for rotating said shaft in response to actuation of said motorized means said motorized means comprising a drive housing, a motor in said drive housing engageable with said shaft by transmission means for rotating said shaft when said motor is actuated, power means for selectively actuating said motor, a switch connected to said power means movable to an activating position and a non-activating position to control the actuation of said power means, a handle mounted to said shaft for manually rotating said shaft when said power means is inactivated, said handle being pivotally mounted to said shaft to be selectively pivoted to a first position and to a second position, said handle being pivoted to said first position and being completely disposed within said drive housing when said power means is in its activated position, and said handle being pivoted to said second position and extending outside of said housing when said power means is in its inactivated position.

28. The assembly of claim 27 wherein said handle is detachably mounted to said shaft.

* * * * *